US007993145B1

(12) United States Patent
Howell et al.

(10) Patent No.: US 7,993,145 B1
(45) Date of Patent: Aug. 9, 2011

(54) SOCKET CONNECTOR HAVING ELECTRICAL CONTACT WITH LOW PROFILE

(75) Inventors: David Gregory Howell, Chandler, AZ (US); Chih-Pi Cheng, Tu-Cheng (TW); Been-Yang Liaw, Tu-Cheng (TW); Cheng-Ching Chien, Tu-Cheng (TW)

(73) Assignee: Hon Hai Precision Ind. Co., Ltd., New Taipei (TW)

( * ) Notice: Subject to any disclaimer, the term of this patent is extended or adjusted under 35 U.S.C. 154(b) by 0 days.

(21) Appl. No.: 12/832,905

(22) Filed: Jul. 8, 2010

(51) Int. Cl.
*H01R 12/00* (2006.01)

(52) U.S. Cl. ..... 439/71; 439/83; 439/81

(58) Field of Classification Search ..... 439/71, 439/83, 81, 84, 862, 66, 78
See application file for complete search history.

(56) References Cited

U.S. PATENT DOCUMENTS

| | | | | |
|---|---|---|---|---|
| 2,947,964 | A * | 8/1960 | Johanson et al. | 439/62 |
| 3,448,345 | A * | 6/1969 | Koehler, Jr. et al. | 361/791 |
| 3,492,628 | A * | 1/1970 | Matthews | 439/81 |
| 4,436,358 | A * | 3/1984 | Coldren et al. | 439/83 |
| 5,443,391 | A * | 8/1995 | Maeda et al. | 439/84 |
| 6,017,246 | A * | 1/2000 | Hisazumi et al. | 439/637 |
| 6,193,567 | B1 * | 2/2001 | Hsieh | 439/853 |
| 6,442,036 | B2 * | 8/2002 | Komatsu | 361/758 |
| 6,511,336 | B1 * | 1/2003 | Turek et al. | 439/249 |
| 7,074,078 | B2 * | 7/2006 | Shotey et al. | 439/536 |
| 7,089,657 | B1 * | 8/2006 | Masumoto | 29/741 |
| 7,198,493 | B2 * | 4/2007 | Chen et al. | 439/66 |
| 2005/0003684 | A1 * | 1/2005 | Huang | 439/71 |
| 2006/0046527 | A1 * | 3/2006 | Stone et al. | 439/66 |
| 2006/0094263 | A1 * | 5/2006 | Chen et al. | 439/66 |
| 2010/0055945 | A1 * | 3/2010 | Lei et al. | 439/81 |

* cited by examiner

*Primary Examiner* — Gary F. Paumen
(74) *Attorney, Agent, or Firm* — Andrew C. Cheng; Wei Te Chung; Ming Chieh Chang

(57) ABSTRACT

A socket connector (100) adapted for electrically connecting a package to a printed circuit board comprises a substrate (2) and a plurality of contacts (3), the substrate (2) comprises a top surface (21), a bottom surface (22) opposite to the top surface (21) and a plurality of passageways (211) impenetrate the top surface (21) and the bottom surface (22), the contact (3) is partly received in the passageway (211) and comprises a body portion (31), at least one leg (33) extends downwardly from the body portion (31) and a spring arm (32) extends upwardly from the body portion (31), the body portion (31) is attached to the top surface of the substrate (2) and the leg (33) goes through the passageway (211) to position the contact (3) on the substrate (2).

19 Claims, 6 Drawing Sheets

SOCKET CONNECTOR HAVING ELECTRICAL CONTACT WITH LOW PROFILE

BACKGROUND OF THE INVENTION

1. Field of the Invention

The present invention relates to a socket connector, and more particularly to a socket connector with low profile.

2. Description of the Related Art

With the development of technology, electrical socket connectors have widespread applications in computers and other electrical devices for transmitting signals and conductive current between a printed circuit board (PCB) and an integrated circuit (IC) package.

A typical LGA socket connector comprises a plastic housing (such as terminal carriers) and multiple terminals received in the plastic housing. The plastic housing comprises a base and four periphery walls surrounding the base, the base defines a plurality of passageways to receive the terminals, the base and the four periphery walls together form a space to receive the IC package.

The terminals each comprises a body portion, a solder portion extending downwardly from the body portion and a spring arm extending upwardly from the body portion. The body portion defines a plurality of barbs. The top portion of the spring arm defines a contact portion contacting with the IC package.

When the contacts are assembled to the passageways of the plastic housing, the barbs interference with the plastic housing to make the terminal securely positioned on the plastic housing. The contact portion extends to the space to contact with the IC package, and the solder portion extends beyond the bottom surface of the base to be soldered to the printed circuit board. Thus, a good electrical connection is established between the IC package and the printed circuit board.

One problem is that the height of this type of LGA socket connector is limited and the size of the socket connector can not be made smaller enough, as the market requests for smaller and smaller socket connector in dimension, a design of a new type socket connector with low profile becomes more and more challenging.

Hence, an improved socket connector is required to overcome the disadvantages of the prior art.

SUMMARY OF THE INVENTION

An object of the invention is to provide a socket connector having contact with low profile assembled to a thinner substrate to reduce the height of the socket connector.

To achieve the above-mentioned object, a socket connector adapted for electrically connecting a package to a printed circuit board comprises a substrate and a plurality of contacts assembled thereon, the substrate comprises a top surface, a bottom surface opposite to the top surface and a plurality of passageways impenetrate the top surface and the bottom surface, the contact is partly received in the passageway and comprises a body portion, at least one leg extends downwardly from the body portion and a spring arm extends upwardly from the body portion, the body portion is attached to the top surface of the substrate and the leg goes through the passageway to position the contact on the substrate.

Other features and advantages of the present invention will become more apparent to those skilled in the art upon examination of the following drawings and detailed description of preferred embodiments, in which:

DETAILED DESCRIPTION OF PREFERRED EMBODIMENT

Reference will now be made in detail to the preferred embodiment of the present invention.

Figure 1:
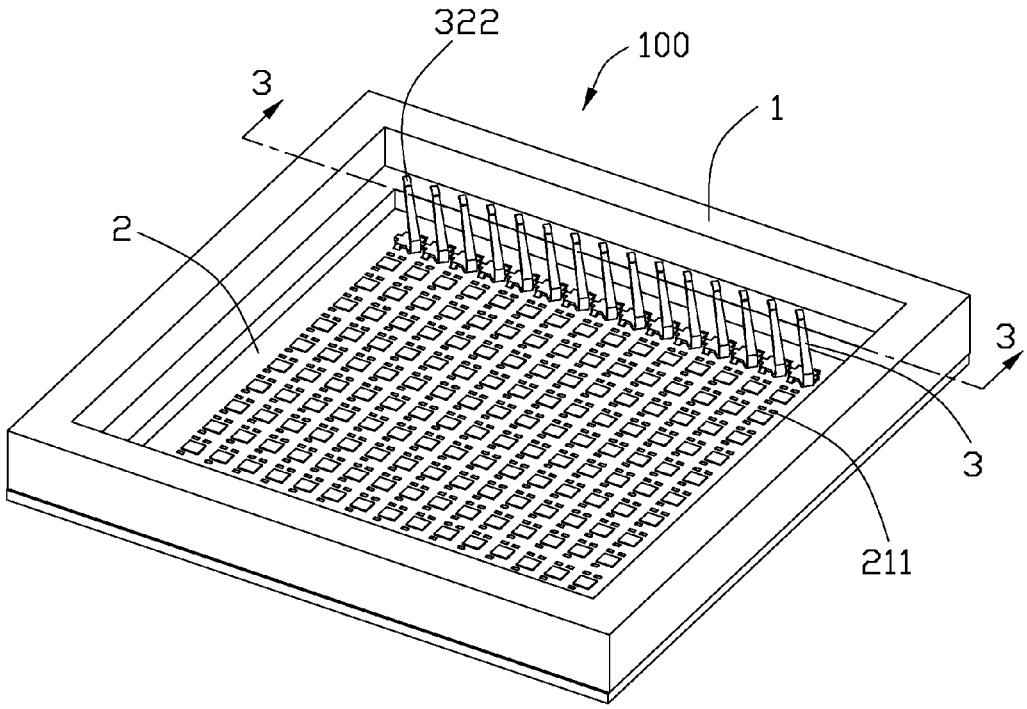
FIG. 1 is an assembled, perspective view of a socket connector in accordance with a preferred embodiment of the present invention, only showing partial contacts.
Figure 2:
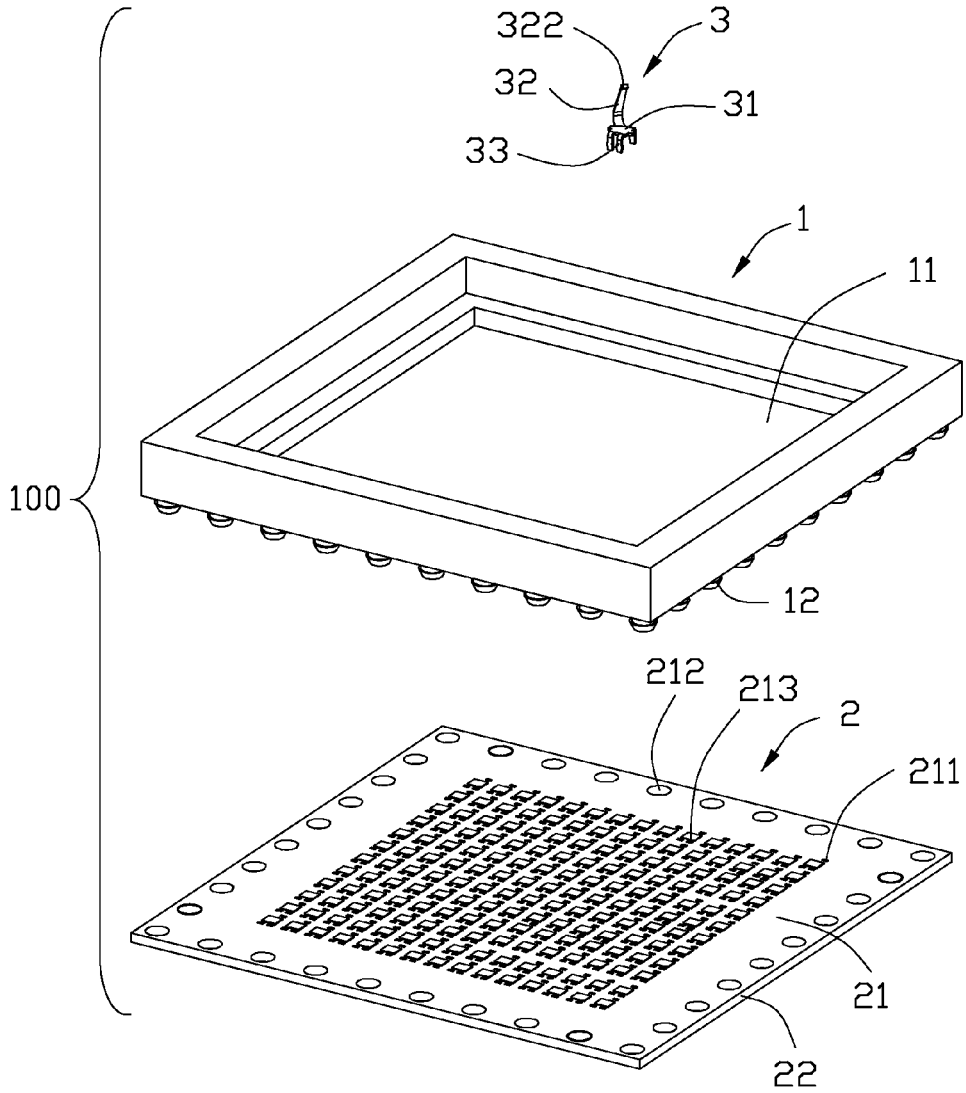
FIG. 2 is an exploded, perspective view of the socket connector shown in FIG. 1.
Figure 3:
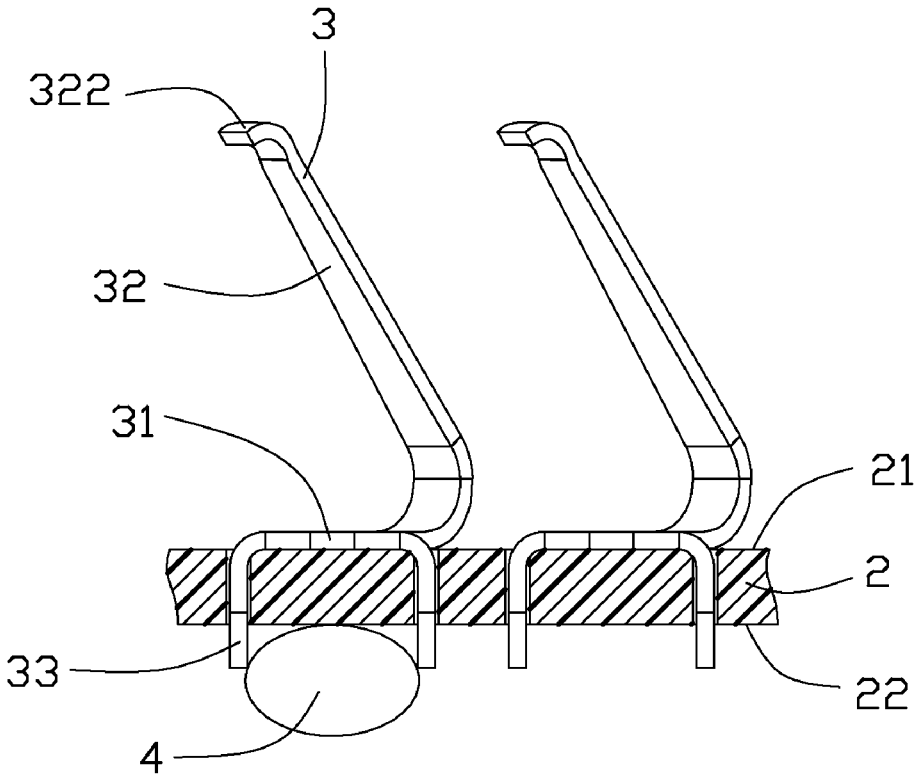
FIG. 3 is a cross-sectional view of the socket connector taken along line 3-3 in FIG. 1.
Figure 4:
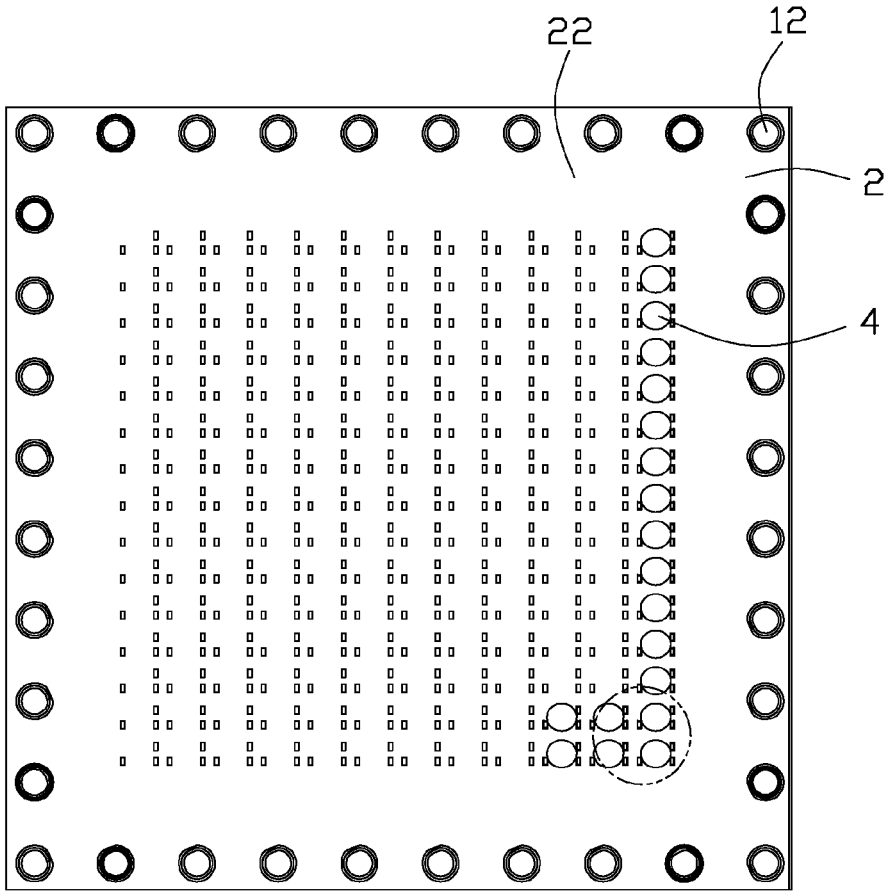
FIG. 4 is a bottom view of the socket connector in FIG. 1.
Figure 5:
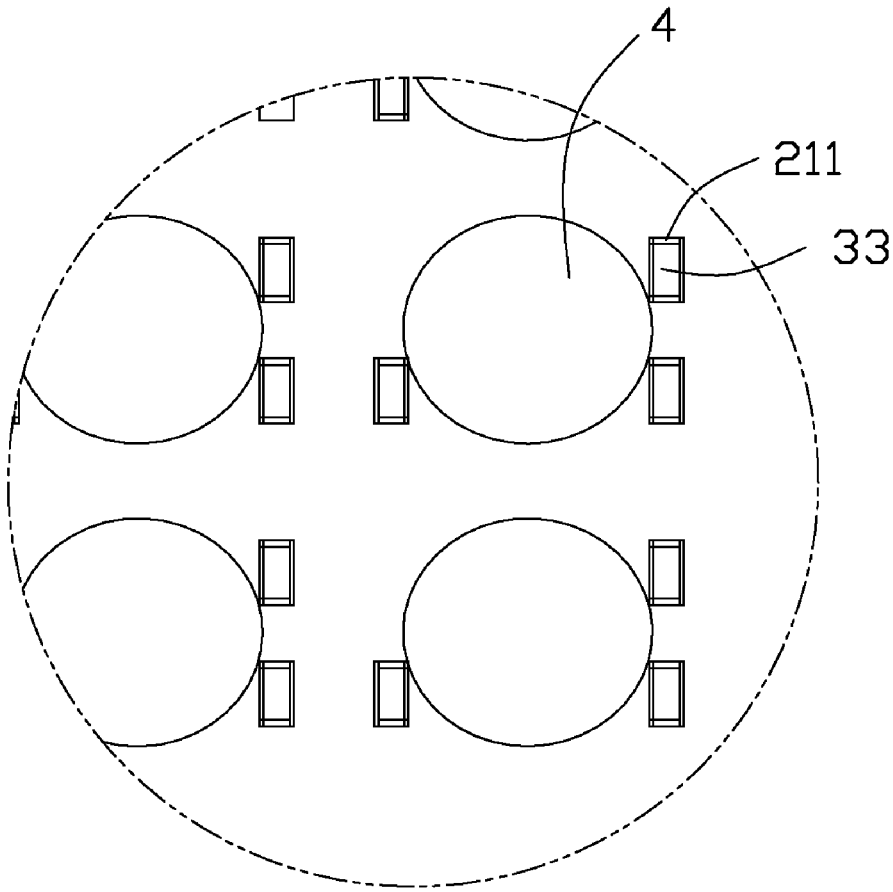
FIG. 5 is an enlarged view of the circle portion of FIG. 4.

Referring to FIGS. 1-2, a socket connector 100 in accordance with a preferred embodiment of the present invention is adapted for electrically connecting an integrated circuit (IC) package (not shown) to a printed circuit board (not shown). The socket connector 100 comprises a substrate 2 with a plurality of contacts 3 assembled thereon and a frame 1 assembled on the substrate 2.

The frame 1 defines a window 11 to receive the IC package and a plurality of posts 12 extending downwardly. The substrate 2 comprises a top surface 21, a bottom surface 22 opposite to each other and a plurality of passageways 211 impenetrate from the top surface 21 to the bottom surface 22. A plurality of through holes 212 are set on the periphery of the substrate 2 corresponding to the posts 12 of the frame 1.

Figure 6:
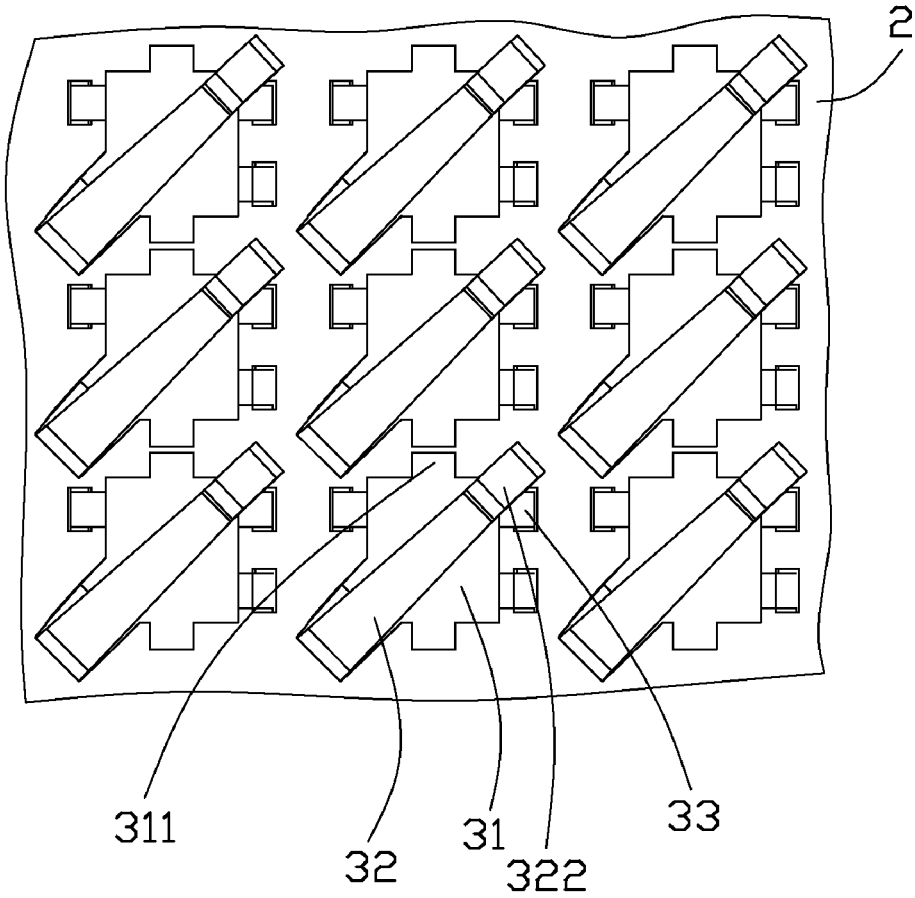
FIG. 6 is a top view of partial of the socket connector of FIG. 1.

The contacts 3 each comprises a plate body portion 31, three legs 33 extending downwardly from the body portion 31 and a spring arm 32 extending upwardly and curvedly from the body portion 31. The top end of the spring arm 32 defines a contact portion 322. Referring to FIG. 6, there are two connecting portions 311 extending from the two opposite sides of the body portion 31, before the contacts 3 are assembled to the substrate 2, the body portion 31 of the two contacts 3 adjacent to each other are connected by the connecting portions 311. Two legs 33 are located on one side of the connecting portion 311 and the other leg 33 is located on the opposite side of the connecting portion 311. The spring arm 32 extends along the direction of the diagonal of the body portion 31.

Referring to FIGS. 2-6, when the socket connector 100 is assembled, the three legs 33 go through the corresponding passageways 211 and are partly go beyond the bottom surface 22 to be soldered with a solder ball 4, the plate body portion 31 is securely positioned on the top surface 21 of the substrate 2 by solder paste 213 setting between the three passageways 211 on the substrate 2 and is paralleled with the substrate 2. The connecting portions 311 of the two adjacent contacts 3 are punched to be disconnected with each other. The posts 12 of the frame 1 go through the through holes 212 of the substrate 1 to securely locate the frame 1 on the substrate 2. The spring arms 32 extend to the window 11 of the frame 1.

The legs 33 of the contact 3 go through the passageways 211 to be soldered to the solder ball 4, so the thickness of the substrate 2 is reduced. At the same time, the contact 3 is positioned on the substrate 2 by the plate body portion 31 be pasted on the top surface 21 of the substrate 2 to reduce the height of the contact 3. Thus, the socket connector 100 can be made with low profile better.

While the present invention has been described with reference to preferred embodiments, the description of the invention is illustrative and is not to be construed as limiting the invention. Various of modifications to the present invention can be made to preferred embodiments by those skilled in the art without departing from the true spirit and scope of the invention as defined by the appended claims.

What is claimed is:

1. A socket connector adapted for electrically connecting a package to a printed circuit board, comprising:

a substrate comprising a top surface, a bottom surface opposite to the top surface and a plurality of passageways extending between the top surface and the bottom surface, the substrate also comprising a plurality of through holes at the periphery thereof;

a frame positioned on the substrate and comprising a plurality of posts each positioned in the corresponding through hole; and a plurality of contacts partly received in the passageways and each comprising a body portion, at least one leg extending downwardly from the body portion and a spring arm extending upwardly from the body portion, the body portion attached to the top surface of the substrate, the leg going through the passageway to position the contact on the substrate.

2. The socket connector as described in claim 1, wherein there are two legs located on a first side of the body portion and one leg located on a second side opposite to the first side.

3. The socket connector as described in claim 2, wherein the contacts each include a pair of connecting portions projecting outwardly from a third and forth sides of the body portion respectively.

4. The socket connector as described in claim 1, wherein the leg extends beyond the bottom surface of the substrate to be soldered with a solder ball.

5. The socket connector as described in claim 1, wherein the body portion is pasted on the substrate by solder paste and is paralleled with the substrate.

6. The socket connector as described in claim 1, wherein the spring arm is located at a corner of the body portion and extends along the diagonal of the body portion.

7. The socket connector as described in claim 1, wherein the frame defines a window and the spring arms of the contacts extend into the window.

8. A socket connector for use with an IC package, comprising:

a substrate comprising a top surface, a bottom surface opposite to the top surface and a plurality of passageways penetrating therethrough;

a plurality of contacts assembled on the substrate and each comprising a body portion positioned on the top surface of the substrate, at least one leg extending downwardly from the body portion and being received in the passageways and a spring arm extending upwardly from the body portion; and a solder ball located on the bottom surface of the substrate and electrically connected with the leg of the contact.

9. The socket connector as described in claim 8, wherein there are two legs located on a first side of the body portion and one leg on a second side opposite to the first side.

10. The socket connector as described in claim 9, wherein the contacts each includes a pair of connecting portions projecting outwardly from a third and forth sides of the body portion respectively.

11. The socket connector as described in claim 8, wherein the body portion is pasted on the top surface of the substrate by solder paste and is paralleled with the substrate.

12. The socket connector as described in claim 8, wherein the spring arm is located at a corner of the body portion and extends along the diagonal of the body portion.

13. The socket connector as described in claim 8, wherein the substrate comprises a plurality of through holes at the periphery thereof, the socket connector also comprises a frame with a plurality of posts each positioned in the corresponding through hole.

14. The socket connector as described in claim 13, wherein the frame defines a window and the spring arm of the contact extends to the window.

15. An electrical connector comprising:

an insulative substrate defining opposite top and bottom surfaces;

a plurality of seating areas formed on the top surface;

a plurality of through holes surrounding each of the seating area and extending through both said top and bottom surfaces;

a plurality of contacts assembled to the substrate on the seating areas, respectively, each of said contacts defining a body portion seated upon the corresponding seating area, a curved spring arm upwardly extending from the body portion, and at least one leg downwardly extending through the corresponding through hole with a bottom end section extending beyond the bottom surface, and a solder ball attached to the bottom end section.

16. The electrical connector as claimed in claim 15, wherein each of said contacts further includes two other legs cooperating with said at least one leg to commonly hold the corresponding solder ball.

17. The electrical connector as claimed in claim 15, wherein said solder ball is essentially seated upon the bottom surface.

18. The electrical connector as claimed in claim 15, wherein said body portion is a plate essentially fully seated upon the corresponding seating area.

19. The electrical connector as claimed in claim 15, wherein no portions of the substrate extend above the top surface among the curved spring arms of the contacts while an insulative frame upwardly extends above the top surface on a periphery of said substrate for cooperating with the substrate to define a receiving cavity for receiving an electronic package therein.

* * * * *